US012144418B2

(12) United States Patent
Van Faasen et al.

(10) Patent No.: US 12,144,418 B2
(45) Date of Patent: Nov. 19, 2024

(54) TABLE WITH WIRE MANAGEMENT SYSTEM

(71) Applicant: MillerKnoll, Inc., Zeeland, MI (US)

(72) Inventors: Joel Graham Van Faasen, Holland, MI (US); John Matthai, Holland, MI (US)

(73) Assignee: Miller Knoll, Inc., Zeeland, MI (US)

( * ) Notice: Subject to any disclaimer, the term of this patent is extended or adjusted under 35 U.S.C. 154(b) by 232 days.

(21) Appl. No.: 17/772,424

(22) PCT Filed: Oct. 28, 2020

(86) PCT No.: PCT/US2020/057802
§ 371 (c)(1),
(2) Date: Apr. 27, 2022

(87) PCT Pub. No.: WO2021/087010
PCT Pub. Date: May 6, 2021

(65) Prior Publication Data

US 2022/0395090 A1 Dec. 15, 2022

Related U.S. Application Data

(60) Provisional application No. 62/927,641, filed on Oct. 29, 2019.

(51) Int. Cl.
*A47B 21/06* (2006.01)

(52) U.S. Cl.
CPC ..... *A47B 21/06* (2013.01)

(58) Field of Classification Search
CPC . A47B 21/06; A47B 21/064; A47B 2021/064; A47B 2021/062
USPC ..... 108/50.02; 312/223.6
See application file for complete search history.

(56) References Cited

U.S. PATENT DOCUMENTS

| | | | | |
|---|---|---|---|---|
| 1,786,823 | A | 12/1930 | Carrington et al. | |
| 4,094,561 | A | 6/1978 | Wolff et al. | |
| 4,296,981 | A | 10/1981 | Hildebrandt et al. | |
| 4,382,642 | A | 5/1983 | Burdick | |
| 4,535,703 | A | 8/1985 | Henriott et al. | |
| 4,748,913 | A | 6/1988 | Favaretto et al. | |
| 4,948,205 | A * | 8/1990 | Kelley | A47B 21/06 D6/648 |

(Continued)

FOREIGN PATENT DOCUMENTS

| | | | |
|---|---|---|---|
| JP | 2011224241 | A | 11/2011 |
| KR | 0119952 | Y1 | 7/1998 |

(Continued)

OTHER PUBLICATIONS

International Search Report with Written Opinion for related Application No. PCT/US2020/057802 dated Mar. 5, 2021 (13 Pages).

*Primary Examiner* — Jose V Chen
(74) *Attorney, Agent, or Firm* — Michael Best & Friedrich LLP

(57) ABSTRACT

A table includes a plurality of legs, a work surface supported by the plurality of legs, a lower rail spaced apart from the work surface and extending between the plurality of legs, and a cable clip. The lower rail includes a channel disposed in an underside of the lower rail. The cable clip is receivable by the channel of the lower rail. The cable clip includes a deformable channel configured to receive wires.

30 Claims, 11 Drawing Sheets

(56) References Cited

U.S. PATENT DOCUMENTS 5,103,741 A * 4/1992 Grund ..... A47B 17/033 312/196
5,144,896 A 9/1992 Fortsch
5,231,562 A * 7/1993 Pierce ..... H02B 1/26 108/50.02
5,277,131 A 1/1994 Fortsch
5,640,912 A * 6/1997 Diffrient ..... A47B 21/06 108/50.02
5,673,632 A * 10/1997 Sykes ..... A47B 21/06 108/50.02
5,934,201 A * 8/1999 Diffrient ..... A47B 21/06 108/50.02
5,934,203 A * 8/1999 Glass ..... A47B 87/002 108/50.02
5,957,062 A * 9/1999 Cox ..... A47B 3/0815 108/133
5,971,508 A 10/1999 Deimen et al.
5,971,509 A 10/1999 Deimen et al.
6,152,048 A * 11/2000 Vander Park ..... A47B 17/003 312/196
6,202,567 B1 * 3/2001 Funk ..... A47B 21/06 108/50.01
6,293,506 B1 * 9/2001 Gutgsell ..... A47B 21/06 108/50.01
6,327,983 B1 12/2001 Cronk et al.
6,329,599 B1 12/2001 Zimmerman
6,336,414 B1 * 1/2002 Stewart ..... A47B 3/0815 108/115
6,349,655 B1 2/2002 Carr et al.
6,360,675 B1 * 3/2002 Jones ..... A47B 9/00 108/50.02
6,402,106 B1 6/2002 Padiak
6,410,855 B1 * 6/2002 Berkowitz ..... A47B 21/06 174/101
6,415,723 B1 * 7/2002 Kopish ..... A47B 21/06 108/50.02
6,435,106 B2 8/2002 Funk et al.
6,448,498 B1 9/2002 King et al.
6,564,723 B2 5/2003 Shapton
6,629,505 B1 10/2003 Cronk et al.
6,647,900 B1 * 11/2003 Kopish ..... A47B 3/0815 108/115
6,769,747 B2 8/2004 Chan et al.
6,817,684 B2 11/2004 Cattaneo
6,848,369 B1 * 2/2005 King ..... A47B 21/06 108/50.01
6,895,868 B1 5/2005 Cronk et al.
7,066,097 B2 6/2006 Gayhart et al.
7,191,713 B2 3/2007 Hart et al.
7,975,624 B2 7/2011 Henriott
9,345,319 B1 5/2016 Heuel
2002/0043183 A1 * 4/2002 Insalaco ..... A47B 21/06 108/50.02
2004/0149177 A1 * 8/2004 Gayhart ..... A47B 21/06 108/50.02
2006/0081157 A1 4/2006 Gayhart et al.
2006/0196995 A1 * 9/2006 Mori ..... H02G 3/30 248/74.2
2007/0204537 A1 * 9/2007 Bastian ..... A47B 83/001 52/220.7
2008/0121147 A1 * 5/2008 Cooke ..... H02G 3/185 108/50.02
2009/0255702 A1 * 10/2009 Mitchell ..... A47B 21/06 174/50
2009/0284655 A1 * 11/2009 Lukes ..... A47B 21/007 108/50.02
2009/0310291 A1 * 12/2009 Willburn ..... A47B 21/00 361/679.22
2010/0024687 A1 * 2/2010 Preiss ..... A47B 21/06 108/50.02
2010/0024688 A1 * 2/2010 Kitada ..... A47B 21/06 108/154
2013/0248242 A1 * 9/2013 Beldock ..... H02B 1/50 174/493
2015/0096472 A1 * 4/2015 Papic ..... A47B 13/003 108/50.02
2015/0230355 A1 * 8/2015 George ..... H05K 5/0221 29/434
2015/0282612 A1 * 10/2015 Rutz ..... A47B 21/06 108/26
2018/0014634 A1 * 1/2018 Pizzinato ..... A47B 21/06
2018/0090915 A1 * 3/2018 Byrne ..... H02B 1/06
2019/0069669 A1 3/2019 Hall et al.
2019/0159589 A1 * 5/2019 Mastry ..... A47B 21/06
2019/0357676 A1 * 11/2019 Matthai ..... H01R 25/006
2019/0379172 A1 * 12/2019 Alexander ..... H02J 3/00
2020/0390237 A1 * 12/2020 Cvek ..... H01R 13/73
2021/0212452 A1 * 7/2021 Colin ..... A47B 87/002
2021/0226430 A1 * 7/2021 Gieselmann ..... H02G 3/32
2021/0353050 A1 * 11/2021 Egger ..... A47B 21/06
2022/0099125 A1 * 3/2022 Fung ..... A47C 13/005
2023/0030047 A1 * 2/2023 Roussel ..... A47B 21/06
2023/0255347 A1 * 8/2023 Jiang ..... H02S 40/34 108/50.02
2023/0397719 A1 * 12/2023 Ryöppy ..... A47B 21/06

FOREIGN PATENT DOCUMENTS

KR 20050015212 A 2/2005
WO WO2004008911 A2 1/2004
WO WO2010083425 A2 7/2010
WO WO2011136740 A1 11/2011
WO WO2011153326 A1 12/2011
WO WO2011153329 A2 12/2011
WO WO2016133820 A1 8/2016
WO WO2017139019 A1 8/2017
WO WO2018149860 A1 8/2018

* cited by examiner

TABLE WITH WIRE MANAGEMENT SYSTEM

CROSS-REFERENCE TO RELATED APPLICATIONS

This application claims priority to U.S. Provisional Application No. 62/927,641, filed Oct. 29, 2019, the entire contents of which are incorporated by reference herein.

FIELD OF THE INVENTION

The present disclosure relates to wire management systems and, more particularly, wire management systems for conference tables.

SUMMARY

In one embodiment, a table includes a plurality of legs, a work surface supported by the plurality of legs, a lower rail spaced apart from the work surface and extending between the plurality of legs, and a cable clip. The lower rail includes a channel disposed in an underside of the lower rail. The cable clip is receivable by the channel of the lower rail. The cable clip includes a deformable channel configured to receive cables.

In another embodiment, a table includes one or more legs, a work surface, and a tray assembly. The work surface is supported by the one or more legs. The tray assembly is positioned beneath the work surface. The tray assembly includes a tray and a hinge. The hinge includes a first part and a second part. The first part is coupled to the work surface and supports the tray. The second part is coupled to the work surface separately from the first part and secures the tray on the first part.

In a further embodiment, a method for assembling a tray assembly to a work surface of a table includes coupling a first part of a hinge to an underside of the work surface and hanging a tray from the first part of the hinge while the first part of the hinge is coupled to the underside of the work surface. The method further includes, coupling a second part of the hinge to the underside of the work surface to secure the tray on the first part of the hinge, after hanging the tray from the first part of the hinge.

In a further embodiment, a table includes one or more legs, a work surface, a rail, and a sling assembly. The work surface is supported by the one or more legs. The rail is coupled to an underside of the work surface. The sling assembly is positioned beneath the work surface. The sling assembly includes a sling, a valence, and a securing clip. The valence is coupled to an edge of the sling. The securing clip is removably coupled to the rail. The valence is removably coupled to the securing clip.

Other aspects of the invention will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
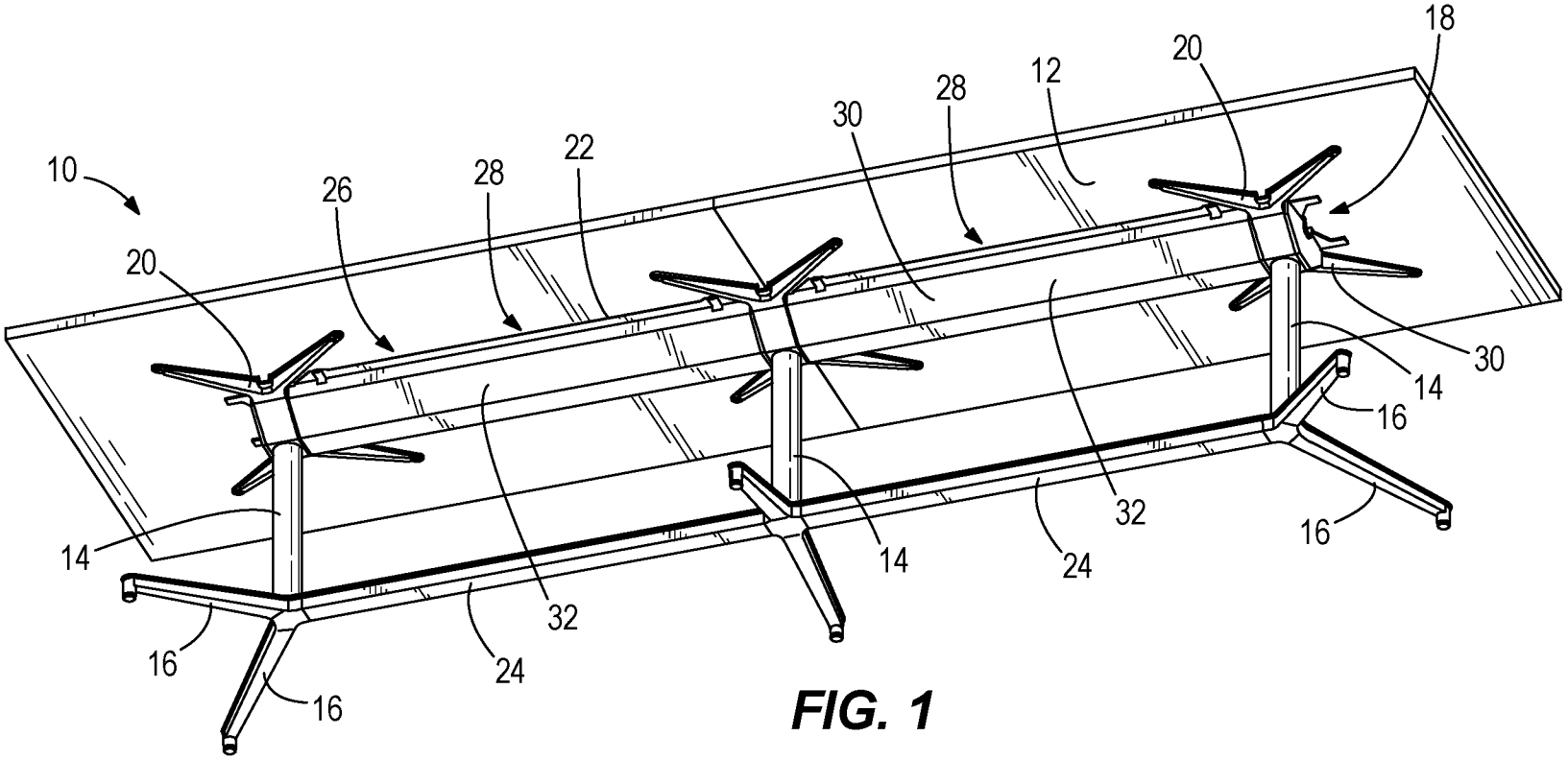
FIG. 1 is a bottom perspective view of a table according to one embodiment of the invention.

FIG. 1 illustrates a table 10. The table 10 may be, for example, a conference table or work bench at which multiple people may sit. In other embodiments, the table 10 may be for a single person. The table 10 generally includes a work surface 12 supported by a plurality of legs 14. In the illustrated embodiment, the work surface 12 is rectangular in shape, although, in other embodiments, the work surface 12 may be circular, octagonal, oblong, or the like. Further, in the illustrated embodiment, the table 10 includes three legs 14. In other embodiments, the table 10 may include fewer or more legs 14, such as one leg, two legs, or four legs. Each leg 14 includes a first end adjacent the work surface 12 and a second end opposite from the work surface 12. Each of the illustrated legs 14 also includes one or more feet 16 extending outwardly from the second end of the leg 14. In some embodiments, the legs 14 may be at least partially hollow to allow wires, cables, or other features to be routed through the legs 14. In other embodiments, wires and cables may be supported on an outside surface of one or more of the legs 14. The illustrated legs 14 have generally circular cross-sections, but may alternatively have square, rectangular, oblong, or other shaped cross-sections. In further embodiments, one or more of the legs may be a cabinet style leg.

Figure 3:
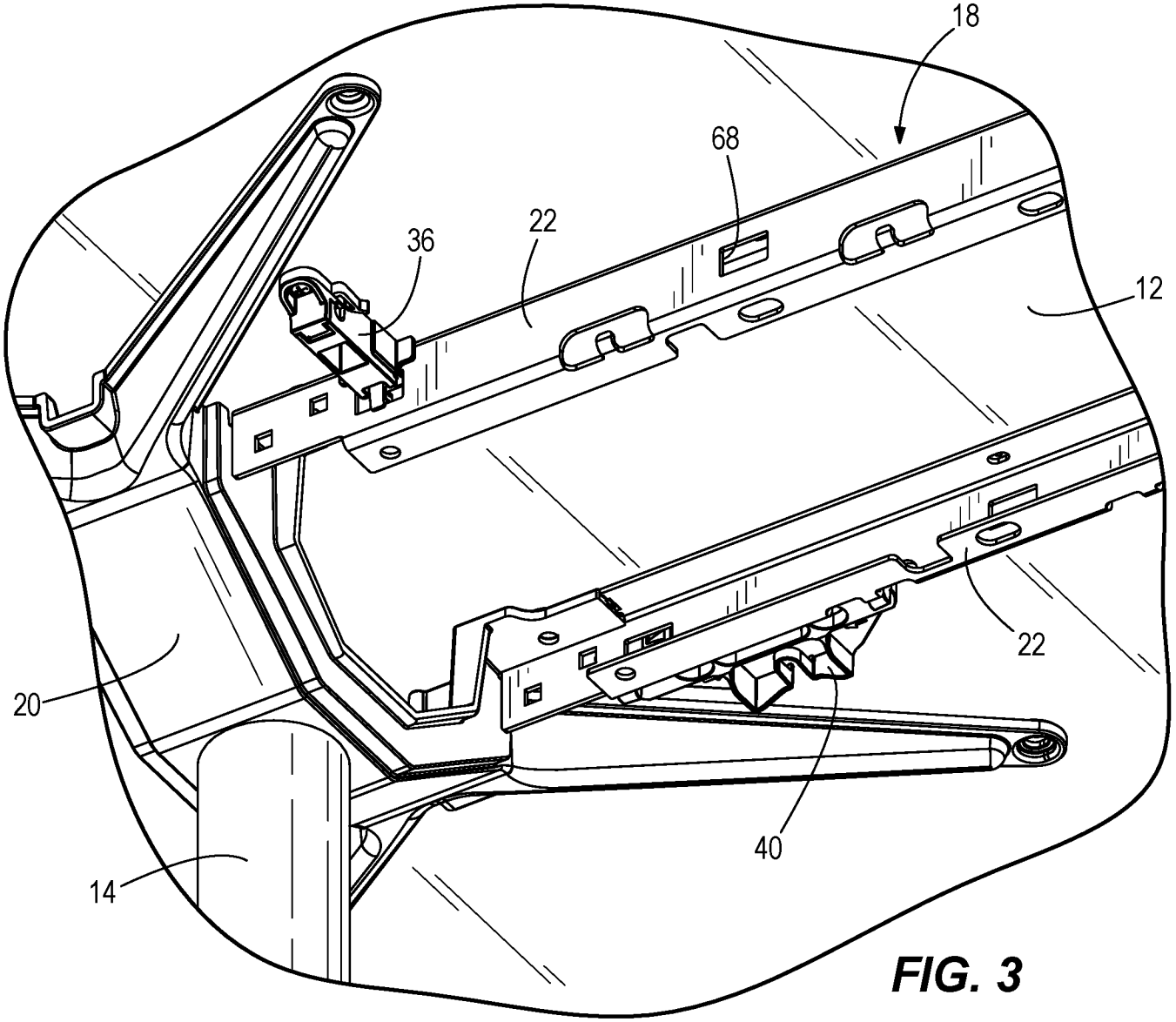
FIG. 3 is a bottom enlarged perspective view of a portion of the table of FIG. 1 with the tray removed.

The work surface 12, or tabletop, is coupled to the plurality of legs 14 via a support frame 18 positioned on an underside of the work surface 12. The support frame 18 may be coupled to the work surface 12 via fasteners, adhesive, and the like. The illustrated support frame 18 includes a plurality of leg brackets 20, one or more support rails 22, and one or more lower rails 24. The leg brackets 20 connect to the first ends of the legs 14. In the illustrated embodiment, the support frame 18 includes two support rails 22 (FIG. 3) extending between each pair of leg brackets 20. The support rails 22 are spaced apart from each other. In other embodiments, the support frame 18 may include a single support rail extending between each pair of leg brackets 20. The illustrated lower rails 24 also extend between the legs 14. In the illustrated embodiment, one lower rail 24 extends between each pair of legs 14.

The table 10 includes a wire or cable management system 26 integrated into the table 10. The wire management system 26 helps route wires (e.g., electrical wires, power cords, data cables, etc.) from, for example, the floor to power receptacles, outlets, and/or ports on or near the work surface 12.

Figure 2:
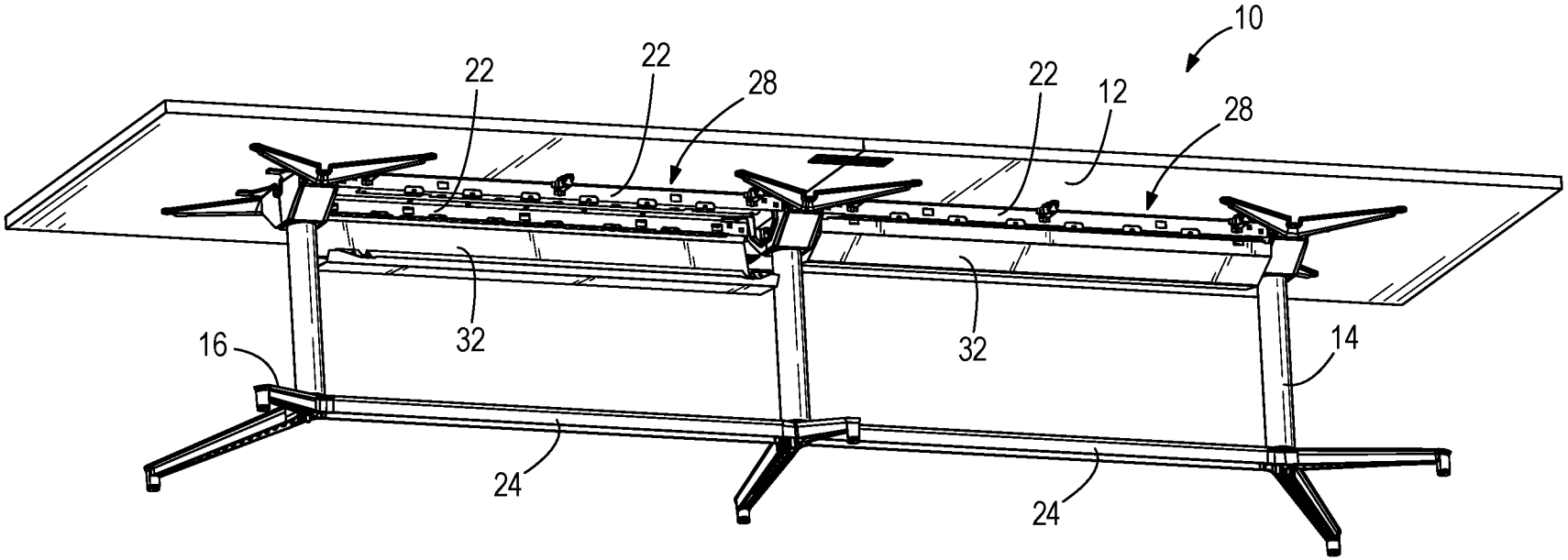
FIG. 2 is a bottom perspective view of the table of FIG. 1 with a tray in an open position.

With reference to FIGS. 1 and 2, the table 10 includes a tray assembly 28 as part of the wire management system 26. The tray assembly 28 include one or more trays 32. The illustrated table 10 includes two trays 32, but may include fewer or more trays 32, depending on the size of the table 10 and number of legs 14. Each tray 32 is disposed between two of the legs 14. The trays 32 provide locations for wires and other accessories to be disposed therein. In some embodiments, an opening may be formed in the work surface 12 to provide access to internal components of the tray 32 from above the work surface 12.

As shown in FIGS. 1 and 2, each tray 32 is moveable between a first or closed position (FIG. 1) and a second or open position (the left tray 32 in FIG. 2). In the illustrated embodiment, the trays 32 are pivotable or rotatable between the closed position and the open position. To allow the tray 32 to move from the open position to the closed position, and vice versa, the tray assembly 28 includes hinges 36. To secure the tray 32 in the closed position, the tray assembly 28 includes latches 40. The latches 40 inhibit rotation of the trays 32 about the hinges 36.

Figure 4:
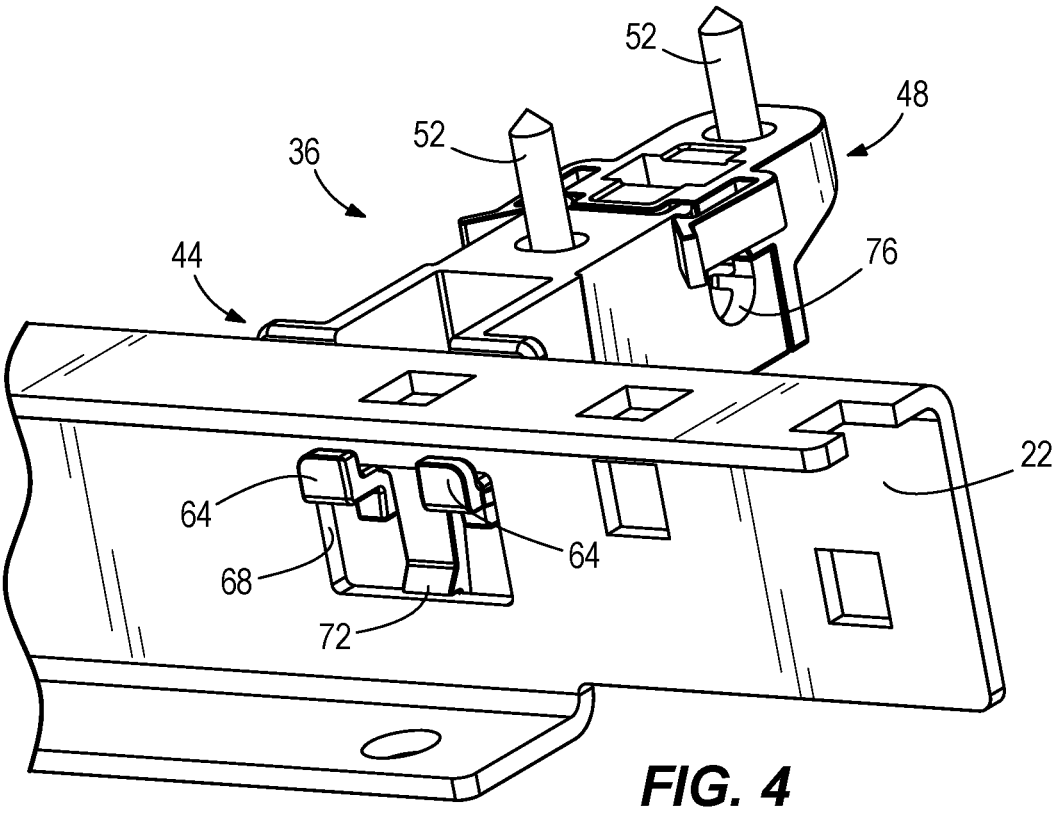
FIG. 4 is a perspective view of a hinge connected to a rail of the table of FIG. 1.
Figure 5A:
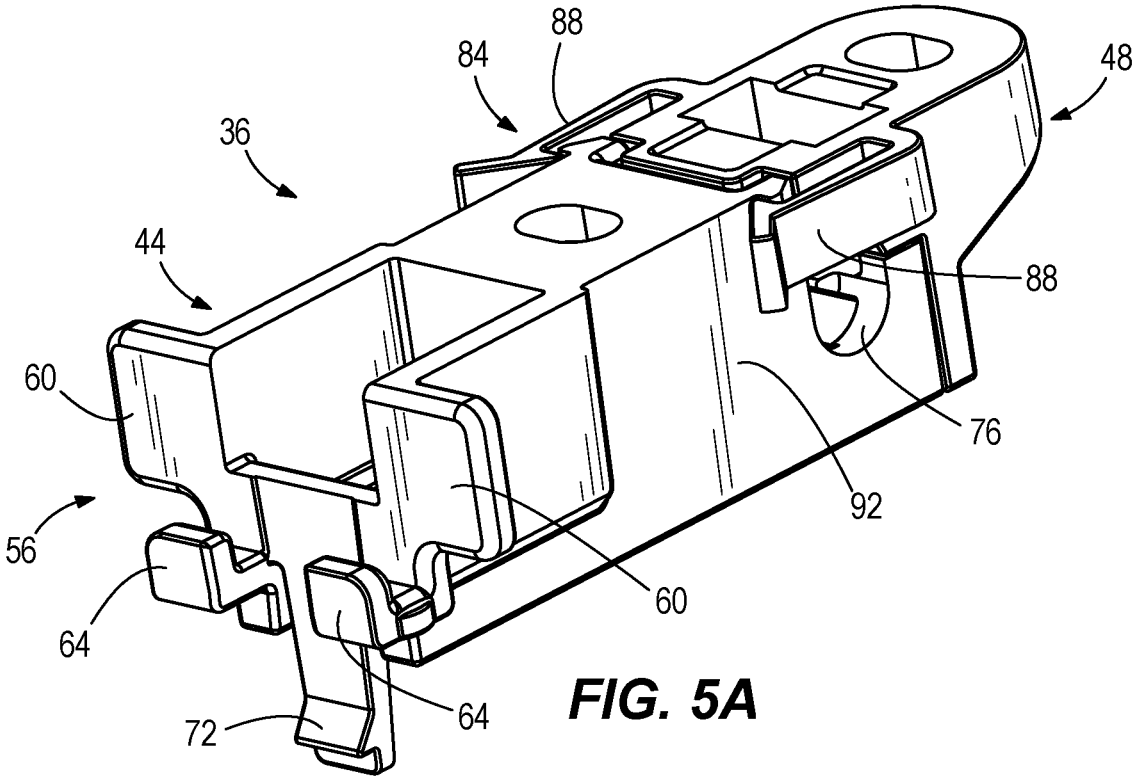
FIG. 5A is perspective view of the hinge of FIG. 4.
Figure 5B:
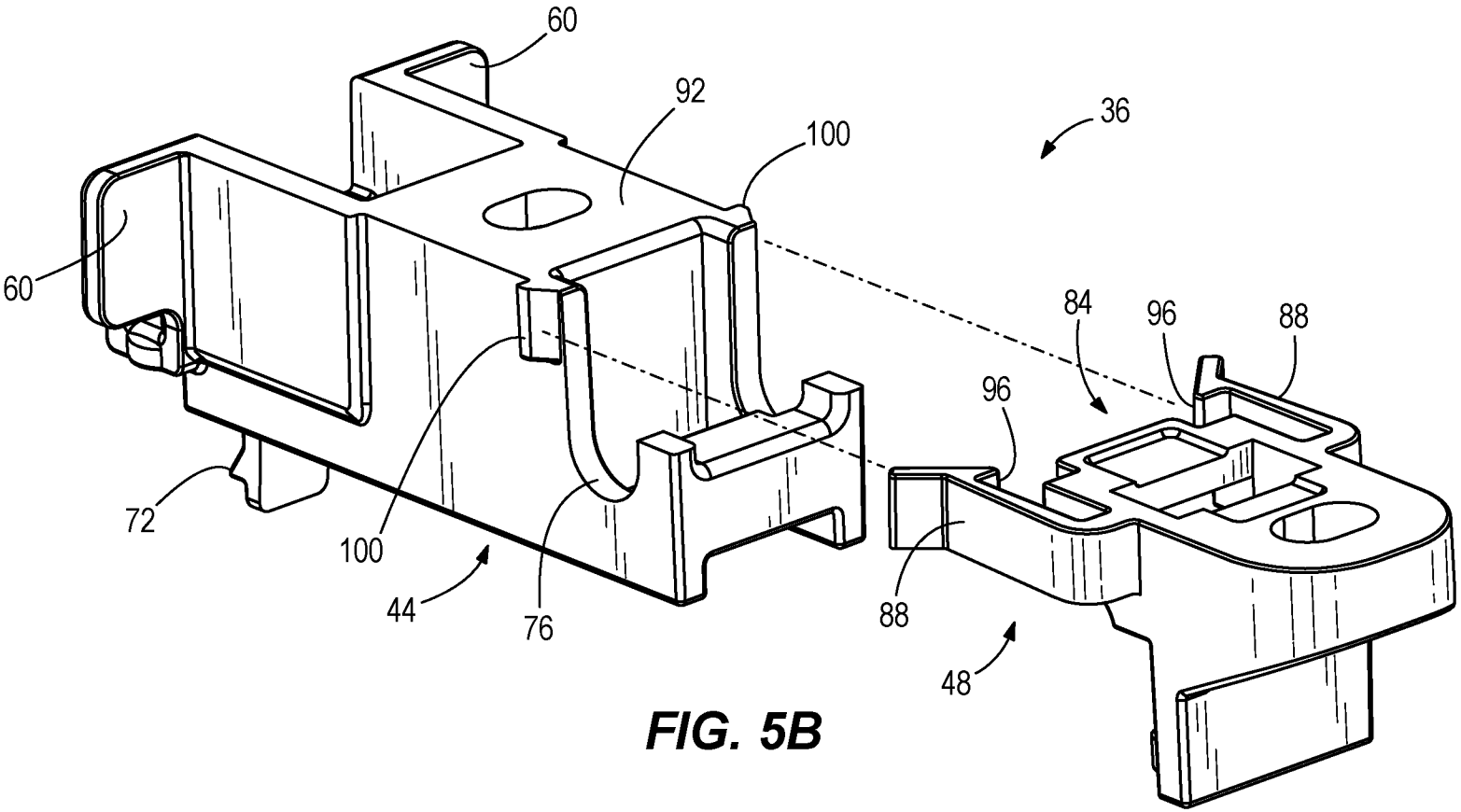
FIG. 5B is an exploded perspective view of the hinge of FIG. 4.

FIGS. 4, 5A, and 5B illustrate one of the hinges 36. Each tray 32 may be supported by one or more hinges 36. The other hinges 36 are the same as the illustrated hinge 36. In the illustrated embodiment, the hinge 36 includes a first part 44 and a second part 48. The first part 44 and the second part 48 are separate elements that are separately coupleable to the work surface 12. In the illustrated embodiment, the first part 44 and the second part 48 are coupled to the work surface 12 via fasteners 52 (e.g., screws). In other embodiments, the first part 44 and/or the second part 48 may be coupled to the work surface 12 using other suitable coupling means. The first part 44 is configured to support the tray 32, while the second part 48 is configured to inhibit removal of the tray 32 from the first part 44.

The first part 44 of the hinge 36 includes a coupling element 56. The coupling element 56 is located at an end of the first part 44. The coupling element 56 is configured to couple the hinge 36 to one of the support rails 22 to help locate the hinge 36 on the underside of the work surface 12. The illustrated coupling element 56 includes winged arms 60 that abut an outer surface of the support rail 22 and hooked arms 64 that interact with an opening 68 in the upper rail 22. The coupling element 56 further includes a finger 72 that extends downwardly from the hooked arms 64. Once the hooked arms 64 have been hooked into the opening 68 in the rail 22, the finger 72 inhibits the hooked arms 64 from becoming unhooked from the opening 68.

The first part 44 further includes a support surface 76. The support surface 76 is located at an end of the first part 44 opposite from the coupling element 56. The support surface 76 is the surface on which a first edge of the tray 32 rotates. The support surface 76 also supports the weight of the tray 32. In the illustrated embodiment, the support surface 76 is a curved or arcuate surface. In other embodiments, the support surface 76 may have other configurations.

The second part 48 of the hinge 36 is coupled to the work surface 12 adjacent the first part 44. In particular, the second part 48 abuts the first part 44. When the second part 48 is coupled adjacent the first part 44, the second part 48 encloses the support surface 76 of the first part 44, such that the first edge of the tray 32 is not able to be removed from the support surface 76 of the first part 44.

The second part 48 includes a latching mechanism 84. The latching mechanism 84 helps locate the second part 48 relative to the first part 44 and temporarily secure the second part 48 to the first part 44 before the second part 48 is secured to the work surface 12 by the fastener 52. The illustrated latching mechanism 84 includes deformable arms 88 formed on the second part 48. The deformable arms 88 are configured to engage a protruding end 92 of the first part 44. To couple the second part 48 to the first part 44, the deformable arms 88 are positioned on each side of the protruding end 92. The deformable arms 88 each include a surface 96 that interacts with a protruding end surface 100 once the protruding end 92 has been inserted between the deformable arms 88. The interaction between the surfaces 96 of the deformable arms 88 and the protruding end surfaces 100 holds the second part 48 relative to the first part 44. In order to remove the second part 48 from the first part 44, a user may deform the deformable arms 88, increasing the distance between the deformable arms 88. This provides adequate distance for removal of the protruding end 92.

To install the hinge 36 to the underside of the work surface 12, the coupling element 56 of the first part 44 is inserted into one of the openings 68 in the rail 22. The first part 44 is then coupled to the underside of the work surface 12 via the fastener 52. Thereafter, the first edge of the tray 32 is hung on the support surface 76 of the first part 44. This arrangement allows the first part 44 of the hinge 36 to support the weight of the tray 32 such that a user can continue to install the hinge 36 without having to hold the tray 32. The second part 48 is then positioned adjacent the first part 44 such that the protruding end 92 of the first part 44 is inserted into the deformable arms 88 of the second part 48, coupling the first part 44 to the second part 48 and inhibiting removal of the tray 32 from the hinge 36. Finally, the second part 48 is coupled to the underside of the work surface 12 via the fastener 52.

Figure 6:
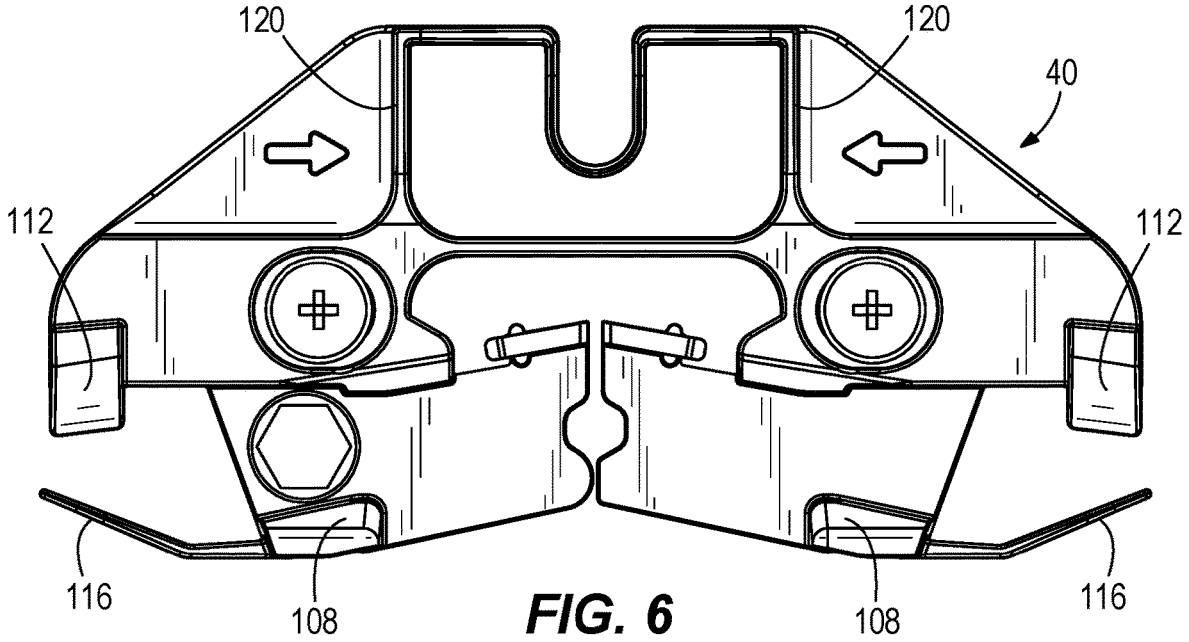
FIG. 6 is a plan view of a latch for use with the table of FIG. 1.
Figure 7:
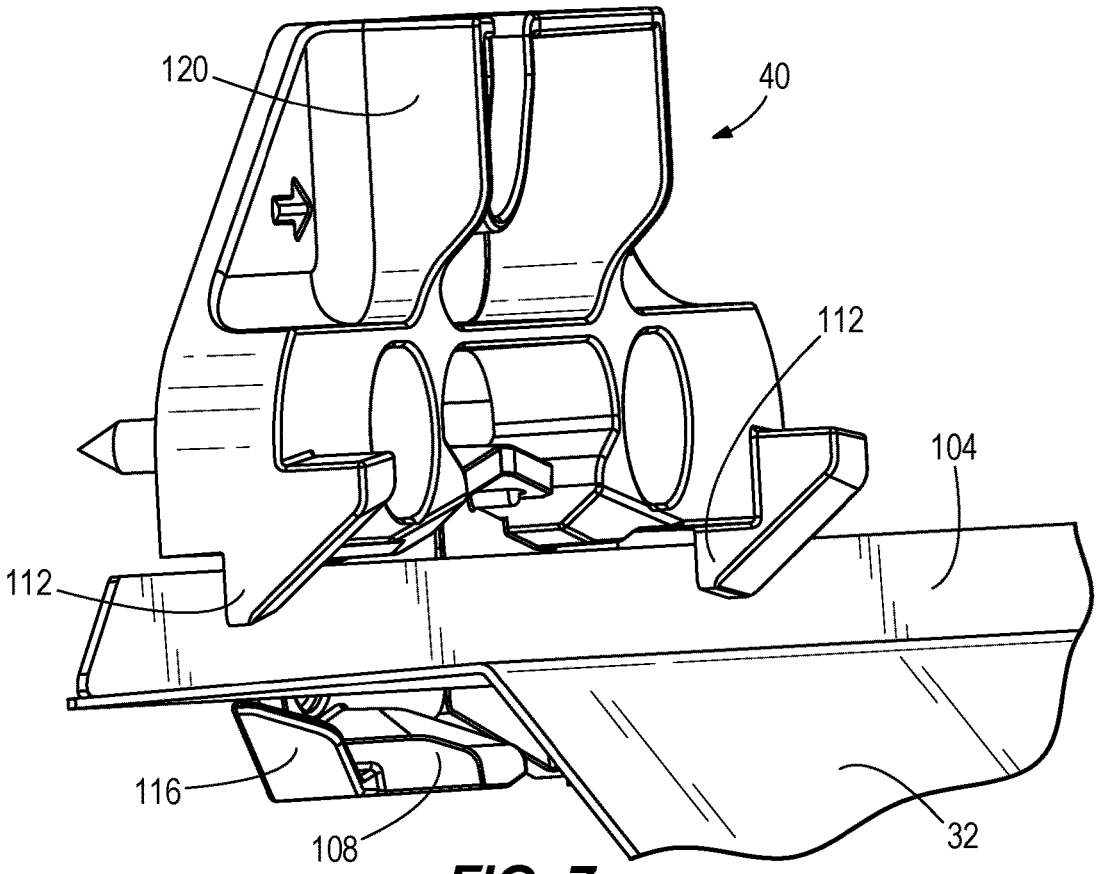
FIG. 7 is a perspective view of the latch of FIG. 6 engaging the tray.

FIGS. 6 and 7 illustrate one of the latches 40. Each of the latches 40 is substantively the same as the illustrated latch 40. The latch 40 is configured to engage a second edge 104 of the tray 32 opposite from the hinges 36 to hold the tray 32 in the closed position. The illustrated latch 40 includes outer arms 108 and shoulders 112. The outer arms 108 include fingers 116 that extend downwardly, away from the underside of the work surface 12. The fingers 116 are angled relative to the support rail 22. The fingers 116 are positioned closer to the support rail 22 than the shoulder 112, such that a space is created between the shoulder 112 and the fingers 116. The second edge 104 of the tray 32 is planar with the shoulder 112, such that the second edge 104 may sit on the shoulder 112. To move the second edge 104 to a position in which the second edge 104 is seated on the shoulder 112, the second edge 104 moves into the space between the shoulder 112 and the fingers 116. The space is smaller than the second edge 104. As such, when the second edge 104 moves into the space, the second edge 104 deforms the fingers 116. During deformation, the fingers 116 change angles relative to the support rail 22, creating additional space adequate for the second edge 104 to pass through. Once the second edge 104 passes the shoulder 112, the second edge 104 sits on the shoulder 112 and the fingers 116 return to an original position. In this position, rotation of the tray 32 is inhibited.

To remove the second edge 104 from the latch 40, a user presses side surfaces 120 of the latch 40. The side surfaces 120 provide actuators on the latch 40. The side surfaces 120 are formed on a section of the latch 40 opposite from the outer arms 108. Pressing the side surfaces 120 of the latch 40 causes the side surfaces 120 to deflect (e.g., pivot) toward each other. This movement causes the shoulders 112 to also deflect (e.g., pivot) away from the outer arms 108. In some embodiments, the side surfaces 120 and the shoulders 112 are formed from a single piece of resilient material, such as plastic. When each side surface 120 is pushed inwardly by the user, the side surface 120 is rotated about an axis. This movement causes the shoulders 112 to also rotate about the axes, creating additional space between the shoulders 112 and the fingers 116. The additional space allows the second edge 104 of the tray 32 to move out of the space such that the tray 32 can rotate to the open position.

The tray 32 is generally U-shaped to allow wires and other objects to be disposed within the tray 32. In use, the tray 32 is opened via pressing the side surfaces 120 of the latch 40, the wires are placed into the tray 32 or removed from the tray 32. At this time, the tray 32 is in the open position. Thereafter, the tray 32 is rotated such that the latches 40 interact with the second edge 104 of the tray 32. At this time, rotation of the tray 32 back to the open position is inhibited and the tray 32 is maintained in the closed position.

Figure 8:
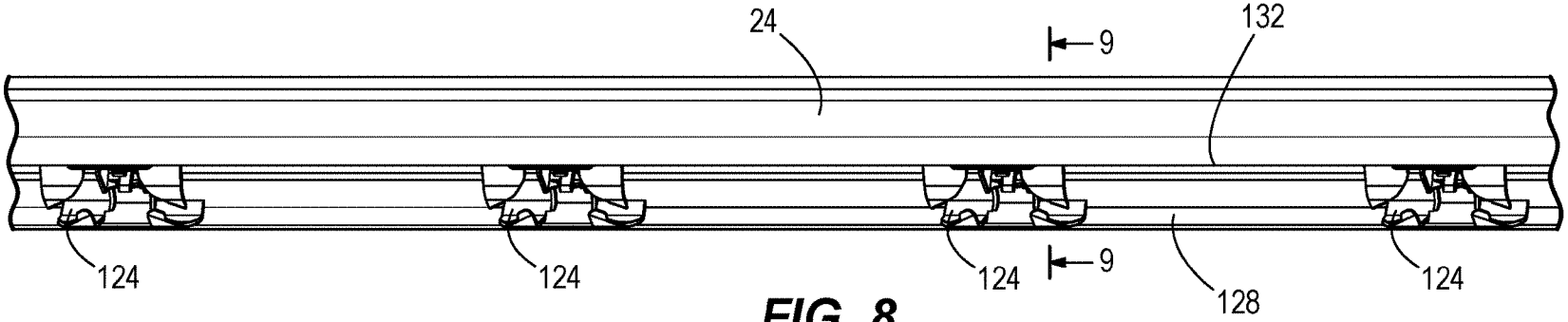
FIG. 8 is a bottom perspective view of a lower rail of the table of FIG. 1.
Figure 9:
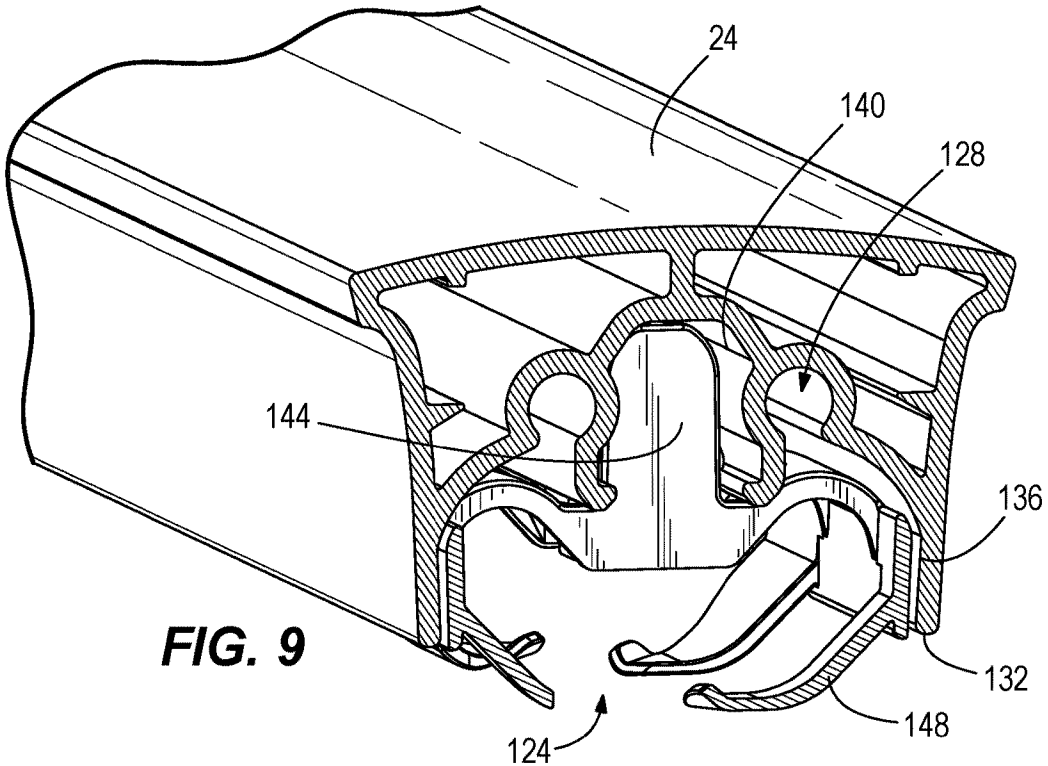
FIG. 9 is a cross-sectional view of the lower rail of FIG. 8.

With reference to FIG. 8, the table 10 also includes the lower rails 24 and one or more cable clips 124 as part of the wire management system 26. As noted above, the lower rail 24 extends between two of the legs 14 (FIG. 1). The table 10 may include a single lower rail 24 or a plurality of lower rails 24, depending on the size of the table 10 and the number of legs 14. The illustrated lower rail 24 includes a channel 128 disposed in an underside 132 of the lower rail 24. The channel 128 is shaped to receive the cable clips 124. As shown in FIG. 9, the channel 128 includes a first or lower channel portion 136 and a second or upper channel portion 140. Both the first and second channel portions 136, 140 extend along the entirety of the lower rail 24. The second channel portion 140 is positioned above and in communication with the first channel portion 136. The second channel portion 140 is also generally smaller than the first channel portion 136. The channel 128 is open at ends of lower rail 24 such that the cable clips 124 may be slid into the channel 128. When the lower rail 24 is coupled to the legs 14, the ends of the channel 128 are blocked by the legs 14, inhibiting removal of the cable clips 124 from the channel 128 through the ends.

Figure 10A:
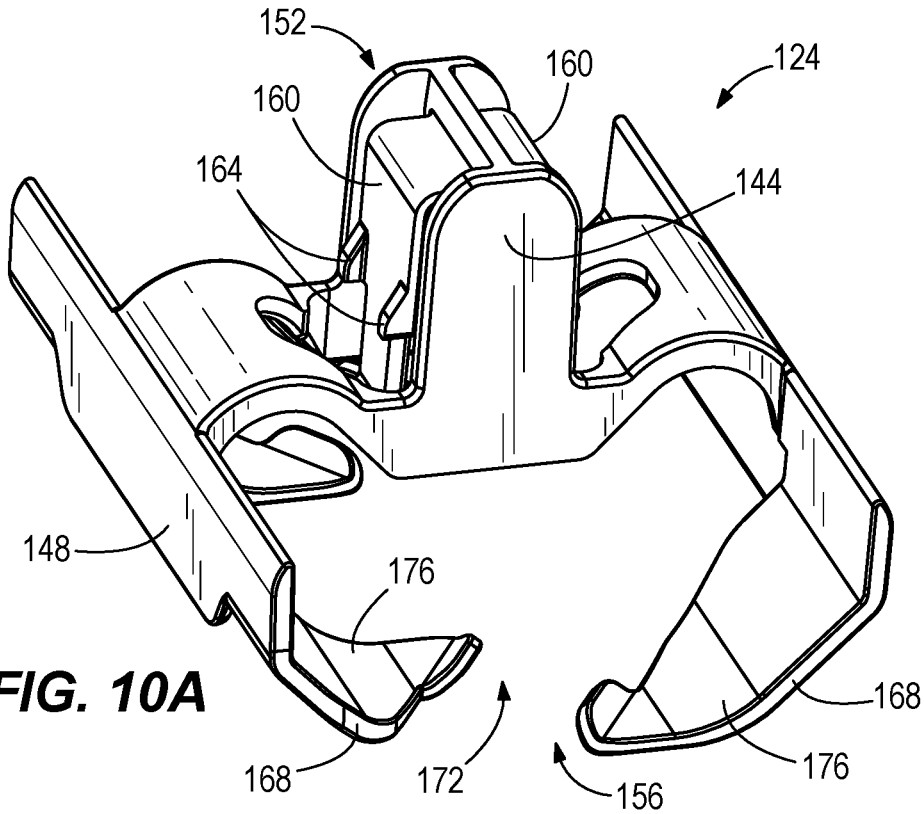
FIG. 10A is a perspective view of a cable clip for use with the lower rail of FIG. 8.
Figure 10B:
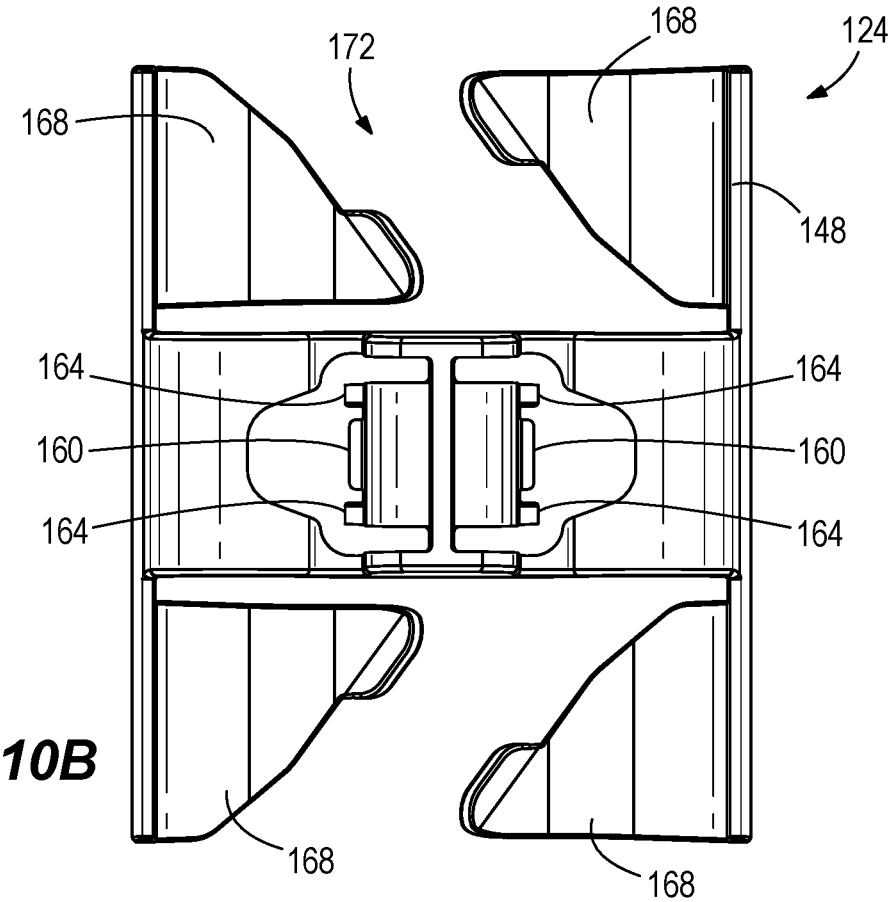
FIG. 10B is a bottom view of the cable clip of FIG. 10A.

FIGS. 10A and 10B illustrate one of the cable clips 124. Each of the other cable clips is substantively the same as the illustrated cable clip 124. The cable clip 124 includes a head 144 and an engagement portion 148. The head 144 is formed at a first or upper end 152 of the cable clip 124. The engagement portion 148 is formed at a second or lower end 156 of the cable clip 124. The head 144 is sized and shaped to fit within the second channel portion 140 of the lower rail 24. The engagement portion 148 is sized and shaped to at least partially fit within the first channel portion 136 of the lower rail 24. The engagement portion 148 also extends partially out of the first channel portion 136, below the underside 132 of the lower rail 24. The head 144 and the engagement portion 148 are integrally formed of a single piece of material, such as plastic.

The illustrated head 144 includes two tabs 160. The tabs 160 extend vertically downward from upper end 156 of the cable clip 124 toward the engagement portion 148. The tabs 160 are cantilevered relative to the head 144 such that each tab 160 may move (e.g., deflect or bend) relative to the head 144. Each tab 144 includes one or more projections 164 extending outwardly therefrom. When the head 144 is positioned within the second channel portion 140, the projections 164 engage sidewalls of the lower rail 24 that define the second channel portion 140 to inhibit the cable clip 124 from falling or being pulled out of the channel 128. The tabs 160 may be moved (e.g., squeezed) inward by a user to disengage the projections 164 from the sidewalls, allowing the cable clip 124 to be removed from the channel 128.

To insert the cable clip 124 into the lower rail 24, the head 144 is aligned with the second channel portion 140 and pushed upward. As the head 144 is pushed upward, the tabs 160 deflect inwardly such that the projections 164 clear the sidewalls of the second channel portion 140. The tabs 160 then deflect back outwardly to engage the sidewalls of the second channel portion 140 and hold the cable clip 124 relative to the lower rail 24. In some embodiments, the projections 164 create a friction fit between the cable clip 124 and the lower rail 24, inhibiting the cable clip 124 from sliding within the channel 128 along the length of the lower rail 24. In other embodiments, the cable clip 124 is slidable within the channel 128 along the length of the lower rail 24 to adjust the position of the cable clip 124 relative to the lower rail 24.

The engagement portion 148 includes a plurality of claws 168. In the illustrated embodiment, the engagement portion 148 includes four claws 168, with two claws 168 being positioned on each side of the cable clip 124. In other embodiments, the engagement portion 148 may include fewer or more claws 168. The claws 168 define a deformable channel 172 between an upper surface 176 of each claw 168 and the head 144. The deformable channel 172 is configured to receive cables or wires to hold the cables or wires relative to the lower rail 24. The claws 168 are also spaced apart from each other. In particular, one claw 168 on each side is generally aligned with another claw 168 on the other side, but with a slight gap between the claws 168. The gap is generally smaller than a width or diameter of the cables or wires to be held in the engagement portion 148. As such, the cables or wires may be pushed through the gap and into the deformable channel 172 by slightly deforming or deflecting the claws 168, but the claws inhibit the cables or wires from falling out of the deformable channel 172 back through the gap.

Figure 11:
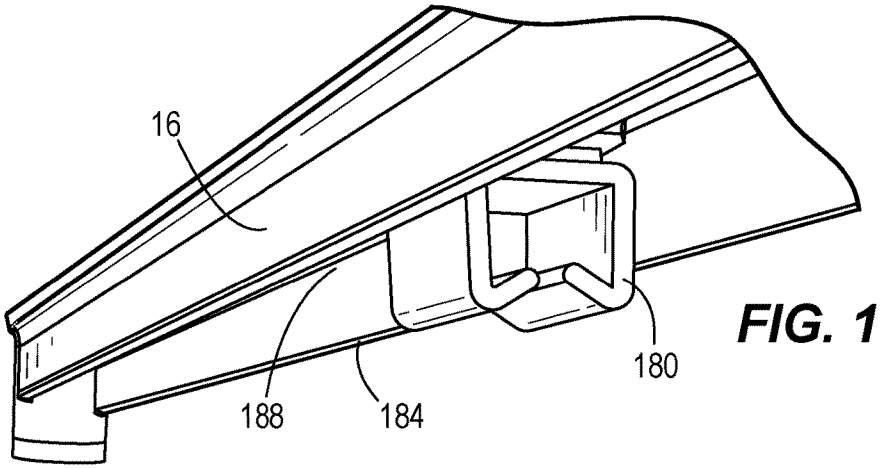
FIG. 11 is a perspective view of a cable clip coupled to a foot of the table.

With reference to FIG. 11, one or more cable clips 180 may additionally be coupled to one of the feet 16 of the table 10. The cable clips 180 may be similar to the cable clips 124 described above or may have different configurations. In some embodiments, the cable clips 180 may be coupled to each of the feet 16. In other embodiments, the cable clips 180 may only be coupled to one of the feet 16 or some of the feet 16. The cable clip 180 may be coupled to an underside 184 of the foot 16 via adhesive. In other embodiments, the cable clip 180 may be coupled to the underside surface 184 of the foot 16 via fasteners (e.g., screws). In further embodiments, the foot 16 may include a channel 188 (which may be similar to the channel 128 formed in the bottom rail 24 (FIG. 9)), and the cable clip 180 may be at least partially received in and coupled to the channel 188 in a similar manner.

In use, the cable clips 128, 180 disposed on the lower rail 24 and/or the feet 16 may hold wires and cables for the table. In some embodiments, the wires and cables may be received in the cable clips 128, 180 such that the wires and cables are fed from the floor (or other source) along the underside surface 184 of the foot 16, along the underside 132 of the lower rail 24, up the hollow interior of one of the legs 14, and into the tray 32. The cable clips 128, 180 allow the wires and cables to be discreetly positioned within the table 10, reducing visibility of the wires and cables.

Figure 12:
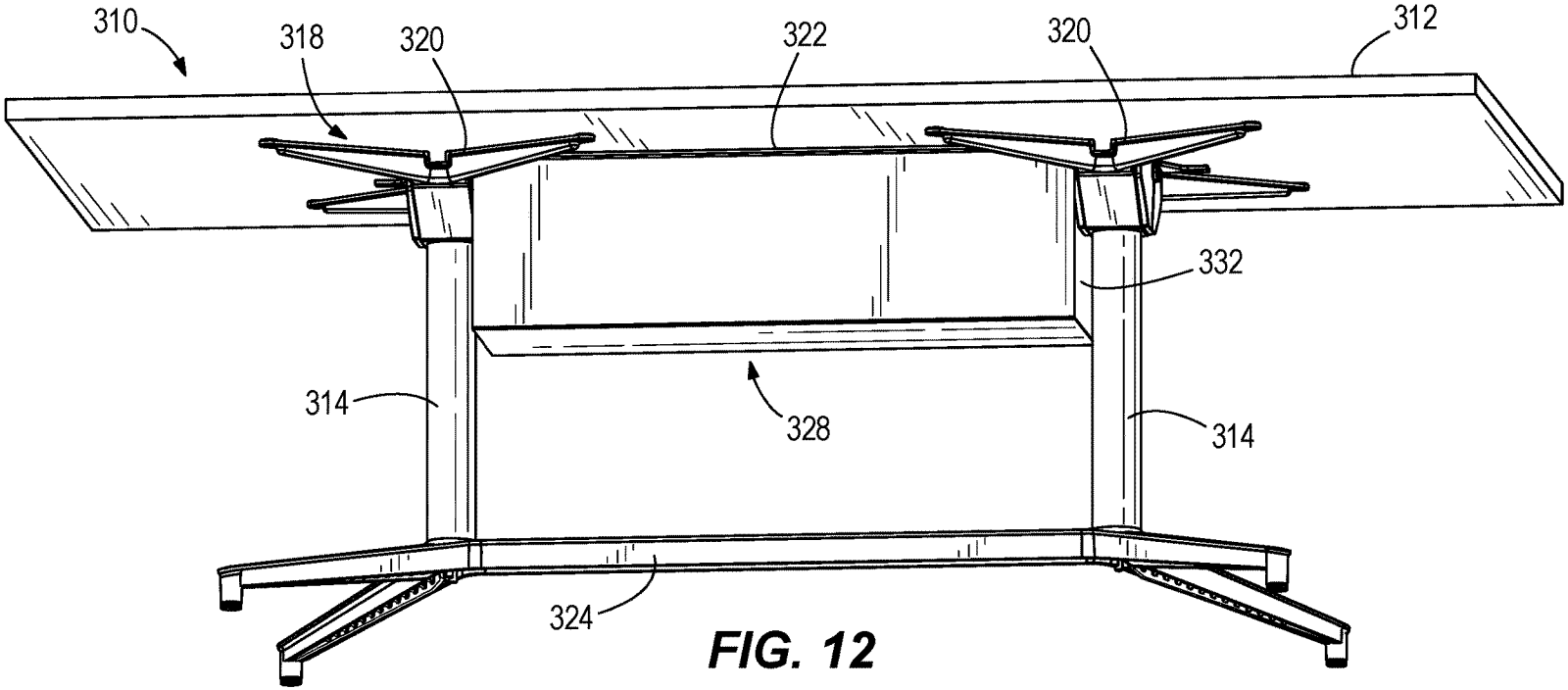
FIG. 12 is a perspective view of a table according to another embodiment of the invention, the table including a sling assembly.

FIG. 12 illustrates another table 310. The table 310 is similar to the table 10 described above and includes a work surface 312 supported by a plurality of legs 314. The table 310 also includes a support frame 318 having a plurality of legs 314, brackets 320, one or more support rails 322, and a lower rail 324. In the illustrated embodiment, the table 310 includes a sling assembly 328 coupled to the support rails 322 beneath the work surface 312, rather than the tray assemblies 28 of FIGS. 1 and 2. The sling assembly 328 is used to at least partially enclose cables, wires, and other accessories positioned beneath the work surface 312.

Figure 13:
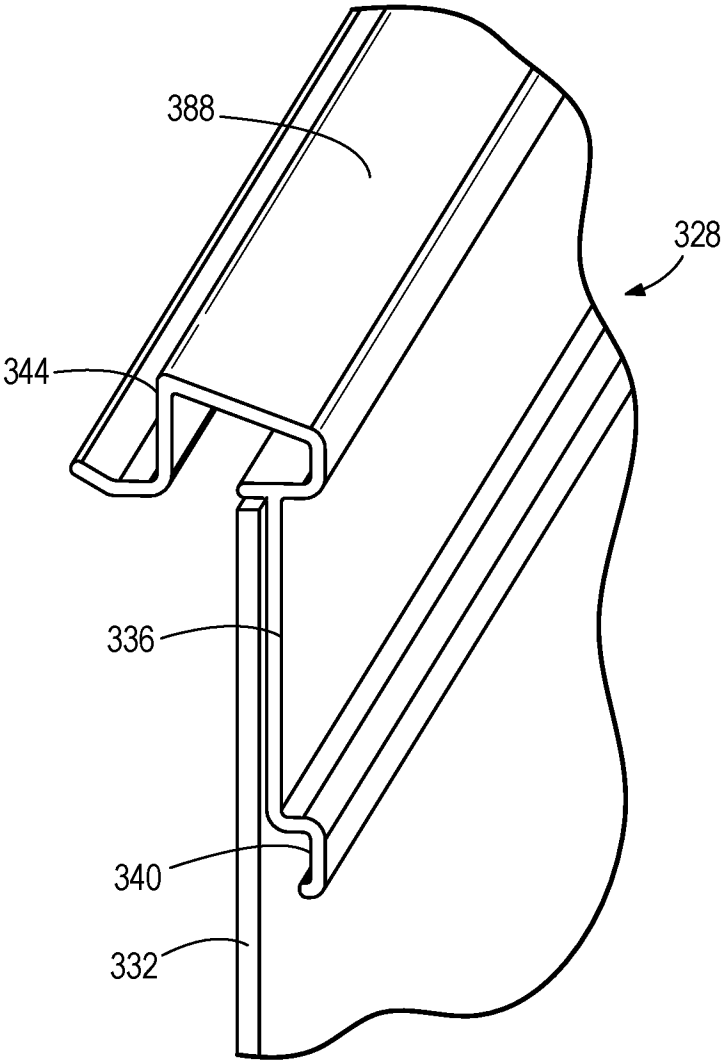
FIG. 13 is an enlarged perspective view of a sling and a valence of the sling assembly of FIG. 12.

As shown in FIG. 13, the sling assembly 328 includes a sling 332 and a valence 336 coupled to the sling 332. The sling 332 may be composed of, for example, fabric. The sling 332 may also include one or more rigid panels positioned within or coupled to the fabric. The panels may give the sling 332 a desired shape, such as the rectilinear shape shown in FIG. 12 with planar side walls and a planar bottom wall. In other embodiments, the sling 332 may be made of other suitable materials.

The valence 336 is coupled to an edge of the sling 332. Although only one valence 336 is shown in FIG. 13, in some embodiments, the sling assembly 328 may include two valences 336 coupled to opposite edges of the sling 332. The valence 336 may be secured to the sling 332 by adhesives, sewing, rivets, or other suitable fastening means. The valence 336 is a rigid strip that extends along the length of the edge of the sling 332. In the illustrated embodiment, the valence 336 extends continuously along the edge. In other embodiments, the valence 336 may extend along a portion of the edge or may be comprised of several pieces that together extend along the edge. The illustrated valence 336 includes a lower channel 340 extending along a lower edge of the valence 336. The illustrated valence 336 also includes an upper peak 344 formed along an upper edge of the valence 336. In some embodiments, the valence 336 may be made of plastic and may be, for example, an extruded piece. In other embodiments, the valence 336 may be made of other suitable materials.

Figure 14:
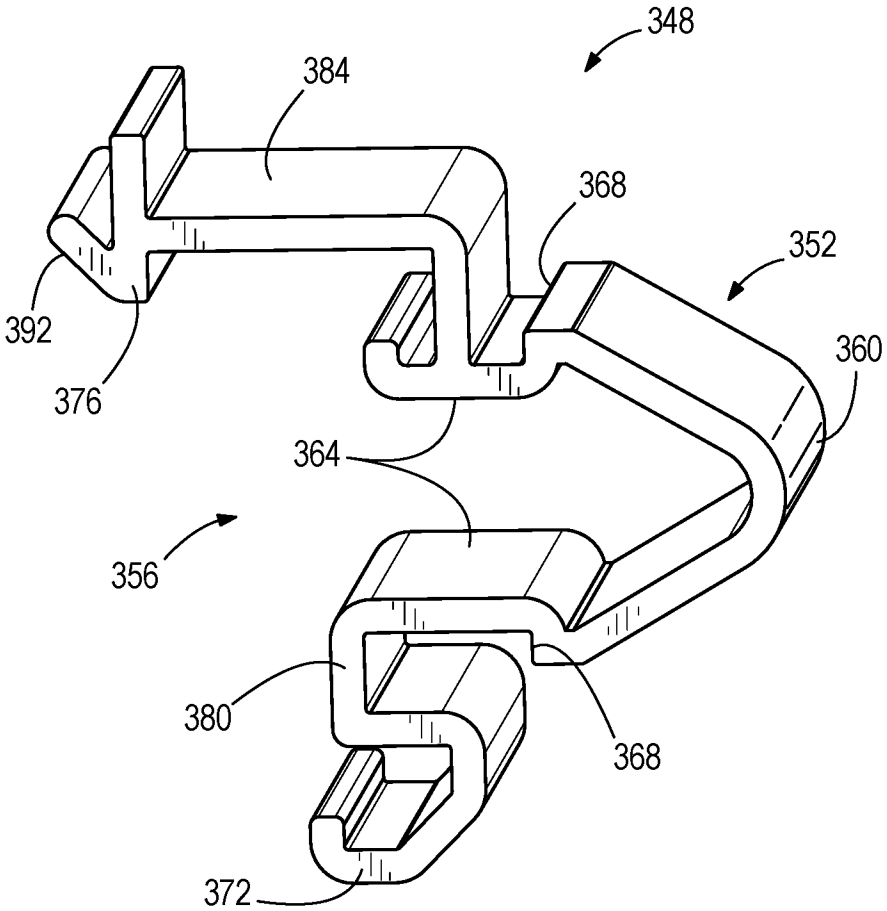
FIG. 14 is a perspective view of a securing clip of the sling assembly of FIG. 12.

The sling assembly 328 also includes one or more securing clips 348, as shown in FIG. 14. The securing clips 348 are configured to couple the valence 336 (and, thereby, the sling 332) to one of the support rails 322 (FIG. 12). Depending on the length of the sling 332, any number of securing clips 348 may be used to couple the sling 332 to the support rail 322. Each securing clip 348 includes a rail engagement portion 352 and a valence engagement portion 356. The rail engagement portion 352 includes an enlarged head 360 connected to a narrower neck 364. The enlarged head 360, or projection, gives the rail engagement portion 352 an arrow-shaped or mushroom-shaped profile. A shoulder 368 is formed between the enlarged head 352 and the neck 356. The valence engagement portion 356 includes a lower hook 372 and an upper tab 376. The lower hook 372 is formed at the end of a lower arm 380 that extends from the neck 356. The upper tab 376, or finger, is formed at the end of an upper arm 384 that extends from the neck 356. In the illustrated embodiment, the rail engagement portion 352 and the valence engagement portion 356 are integrally formed as a single piece such that the securing clip 348 is a unitary body. In other embodiments, the securing clip 348 may be formed of multiple pieces that are coupled together. The securing clip 348 is made of a relatively resilient material, such as plastic, such that the securing clip 348 may temporarily bend and deflect during use.

Figure 15:
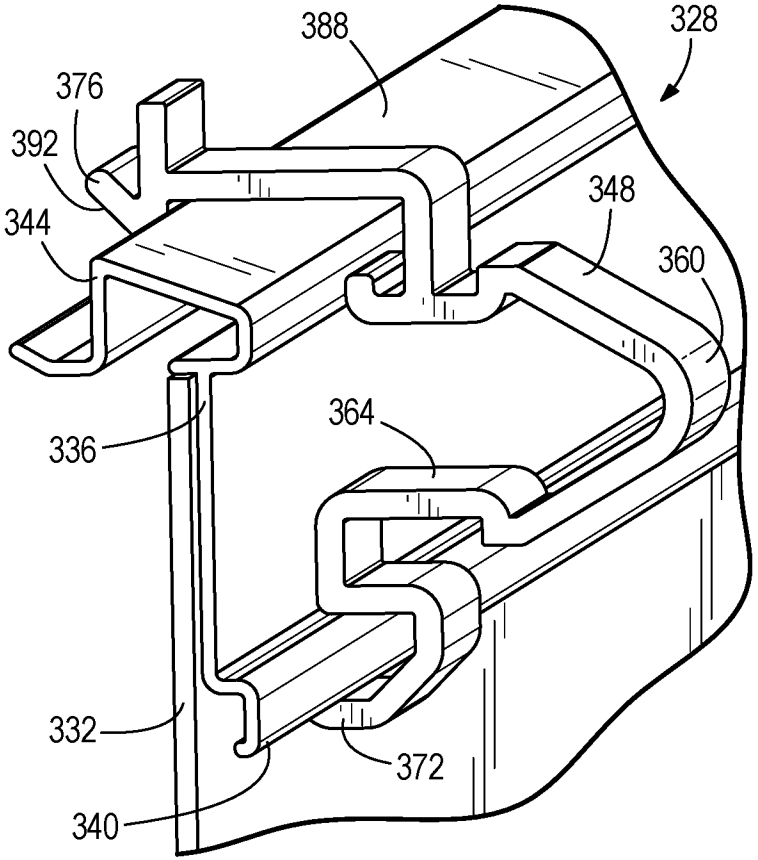
FIG. 15 is a perspective view of the sling and the valence of FIG. 13 coupled to the securing clip of FIG. 14.

As shown in FIG. 15, the valence engagement portion 356 is configured to engage the valence 336 to couple the sling 332 to the securing clip 348. The lower hook 372 of the securing clip 348 engages the lower channel 340 of the valence 336 to support the valence 336. The upper tab 376 of the securing clip 348 also engages the upper peak 344 of the valence 336 to secure the valence 336 to the securing clip 348. Since the securing clip 348 is made of a resilient material, the securing clip 348 can temporarily deflect (e.g., the upper tab 376 can move away from the lower hook 372) to provide clearance for connecting the valence 336 to the securing clip 348. Corresponding ramped surfaces 388, 392 on the upper edge of the valence 336 and the upper tab 376 of the securing clip 3448 automatically deflect the upper tab 376 relative to the lower hook 372 while pushing the valence 336 into the valence engagement portion 356. To remove the valence 336 from the securing clip 348, the upper tab 376 is moved away from the lower hook 372 such that the upper peak 344 clears the upper tab 376. The lower channel 340 can then be lifted off of the lower hook 372 to remove the valence 336 from the valence engagement portion 356.

Figure 16:
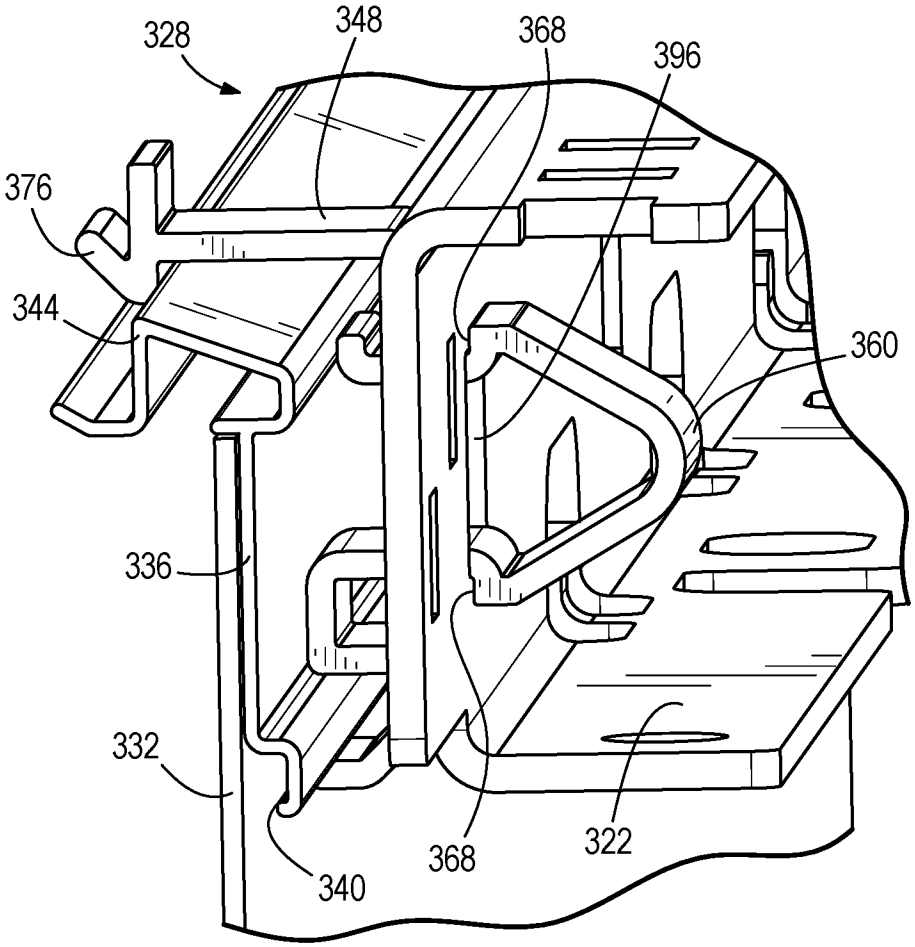
FIG. 16 is a perspective view of the sling, the valence, and the securing clip of FIG. 15 coupled to a support rail.

As shown in FIG. 16, the rail engagement portion 352 is configured to engage one of the support rails 322 (FIG. 12) of the table 310. The support rail 322 includes a series of openings 396 spaced apart along a length of the rail 322. In some embodiments, the openings 396 may be the same as the openings 68 shown in FIG. 3. The enlarged head 360 of the securing clip 348 is sized and shaped to fit within the openings 396. As the enlarged head 360 is pushed into one of the openings 396, the head 360 may temporarily deflect (e.g., compress together) due to the resiliency of the securing clip 348. Once the shoulder 368 clears the opening 396, the enlarged head 360 may then deflect back to its original shape. The shoulder 368 then engages the support rail 322 to inhibit the enlarged head 360 from being pulled back out of the opening 396. To remove the securing clip 348 from the support rail 322, the lower hook 372 and the upper tab 376 of the valence engagement portion 356 are moved toward each other (e.g., squeezed together) to temporarily deflect the enlarged head 360. When sufficiently compressed, the enlarged head 360 may be pulled out of the opening 396.

When the valence 336 is coupled to the securing clip 348, however, the valence 336 inhibits the upper tab 376 from moving toward the lower hook 372, thereby inhibiting the rail engagement portion 352 from unintentionally disengaging the support rail 322. As such, the valence 336 is typically connected to the securing clip 348 after the securing clip 348 is coupled to the support rail 322, and is typically removed from the securing clip 348 before the securing clip 348 is removed from the support rail 322.

Although the sling assembly 328 is illustrated with respect to one of the support rails 322, the sling assembly 328 may include a second valence and one or more securing clips to connect the sling assembly 328 to the other support rail 322. Alternatively, the sling assembly 328 may be permanently coupled to the other support rail 322 or may be coupled to the other support rail 322 using other suitable mechanisms (e.g., a hinge).

Various features and advantages of the disclosure are set forth in the following claims.

What is claimed is:

1. A table comprising:

a plurality of legs, each leg having a first end and second end opposite the first end;

a work surface supported by the plurality of legs, the work surface coupled to the first ends of the plurality of legs;

a lower rail coupled to the second ends of the plurality of legs and spaced apart from the work surface, the lower rail extending between the plurality of legs, the lower rail including a channel disposed in an underside of the lower rail; and a cable clip receivable by the channel of the lower rail, the cable clip including a deformable channel configured to receive cables.

2. The table according to claim 1, wherein the cable clip has a head at a first end and an engagement portion at a second end opposite the first end.

3. The table according to claim 2, wherein the channel has a first channel portion and a second channel portion in communication with the first channel portion, and wherein the head is configured to fit within the second channel portion and the engagement portion is configured to fit at least partially within the first channel portion.

4. The table according to claim 3, wherein the head includes a cantilevered tab extending from the first end of the cable clip towards the engagement portion, and wherein the tab engages a side wall of the lower rail that defines the second channel portion.

5. The table according to claim 1, wherein the cable clip includes a plurality of claws positioned on opposite sides of the cable clips, and wherein the plurality of claws partially defines the deformable channel.

6. The table according to claim 1, further comprising:

a foot extending outwardly from one of the plurality of legs; and a second cable clip including a deformable channel configured to receive the cables, the second cable clip being coupled to the foot.

7. The table according to claim 1, further comprising a tray assembly positioned beneath the work surface, the tray assembly including a tray and a hinge, the hinge having a first part and a second part, the first part coupled to the work surface and supporting the tray, the second part coupled to the work surface separately from the first part and securing the tray on the first part.

8. The table according to claim 7, further comprising an upper rail coupled to an underside of the work surface, wherein the first part of the hinge includes winged arms that abut an outer surface of the upper rail, hooked arms that hook on to an opening in the upper rail, and a finger that extends from the hooked arms and inhibits the hooked arms from unhooking from the opening.

9. The table according to claim 7, wherein the first part of the hinge includes a support surface on which a first edge of the tray rotates, and wherein the second part of the hinge is coupled to the first part so that the second part encloses the first edge of the tray on the support surface of the first part.

10. The table according to claim 7, wherein the first part of the hinge includes a protruding end, wherein the second part of the hinge includes deformable arms positioned on each side of the protruding end, and wherein the deformable arms each include a surface interacting with a protruding end surface of the protruding end so that the second part is held in place relative to the first part.

11. The table according to claim 7, further comprising a latch coupled to an underside of the work surface, the latch configured to engage an edge of the tray opposite from the hinge to hold the tray in a closed position.

12. The table according to claim 1, further comprising:

an upper rail coupled to an underside of the work surface; and a sling assembly positioned beneath the work surface, the sling assembly including a sling, a valence coupled to an edge of the sling, and a securing clip removably coupled to the rail, the valence being removably coupled to the securing clip.

13. The table according to claim 12, wherein the securing clip includes a rail engagement portion having a head and a shoulder formed on the head, wherein the head is received in an opening of the upper rail and the shoulder engages the rail so that the head is inhibited from being pulled out of the opening of the upper rail.

14. The table according to claim 12, wherein the valence includes a lower channel extending along a lower edge of the valence and an upper peak formed along an upper edge of the valance, and wherein the securing clip includes a valance engagement portion having an upper tab engaging the upper peak of the valence and a lower hook engaging the lower channel of the valence.

15. The table according to claim 12, wherein the securing clip is made of a resilient material.

16. A table comprising:

one or more legs;

a work surface supported by the one or more legs; and a tray assembly positioned beneath the work surface, the tray assembly including a tray, and a hinge including a first part and a second part, the first part coupled to the work surface and having a support surface that receives an edge of the tray to support the tray, the second part coupled to the work surface separately from the first part, the second part positioned adjacent the first part to inhibit removal of the tray from the support surface of the first part, wherein the tray is hung on the support surface and is configured to move relative to the work surface and the hinge while supported by the first part.

17. The table according to claim 16, further comprising a rail coupled to an underside of the work surface, wherein the first part of the hinge includes a coupling element that couples the hinge to the support rail to help locate the hinge on the underside of the work surface.

18. The table according to claim 17, wherein the coupling element includes winged arms that abut an outer surface of the rail, hooked arms that hook on to an opening in the rail, and a finger that extends from the hooked arms and inhibits the hooked arms from unhooking from the opening.

19. The table according to claim 16, wherein the first part of the hinge includes a support surface on which a first edge of the tray rotates, and wherein the second part of the hinge is coupled to the first part so that the second part encloses the first edge of the tray on the support surface of the first part.

20. The table according to claim 19, wherein the support surface is an arcuate surface.

21. The table according to claim 19, further comprising a latch coupled to an underside of the table, the latch configured to engage a second edge of the tray opposite from the hinge to hold the tray in a closed position.

22. The table according to claim 16, wherein the first part of the hinge includes a protruding end, wherein the second part of the hinge includes deformable arms positioned on each side of the protruding end, and wherein the deformable arms each include a surface interacting with a protruding end surface of the protruding end so that the second part is held in place relative to the first part.

23. A method for assembling a tray assembly to a work surface of a table, the method comprising:

coupling a first part of a hinge to an underside of the work surface;

hanging a tray from a support surface on the first part of the hinge while the first part of the hinge is coupled to the underside of the work surface, the support surface allowing movement of the tray relative to the work surface and the hinge while the tray is supported on the support surface of the first part; and after hanging the tray from the support surface of the first part of the hinge, coupling a second part of the hinge to the underside of the work surface adjacent the first part to inhibit removal of the tray from the support surface of the first part of the hinge.

24. The method of claim 23, wherein the table includes a rail coupled to the underside of the work surface, and wherein the method further comprises coupling the first part of the hinge to the rail to help locate the hinge on the underside of the work surface.

25. The method according to claim 23, wherein hanging the tray from the first part of the hinge includes hanging a first edge of the tray from a support surface of the first part of the hinge, and wherein the method further comprises coupling the second part of the hinge to the first part of the hinge to enclose the first edge of the tray on the support surface.

26. The method according to claim 23, further comprising:

coupling a latch to the underside of the work surface;

rotating the tray on the hinge relative to the work surface to a closed position; and engaging an edge of the tray opposite from the hinge with the latch to hold the tray in the closed position.

27. A table comprising:

one or more legs;

a work surface supported by the one or more legs;

a rail coupled to an underside of the work surface; and a sling assembly positioned beneath the work surface, the sling assembly including a sling, a valence coupled to an edge of the sling, and a securing clip removably coupled to the rail, wherein the valence is removably coupled to the securing clip to removably couple the valence to the rail.

28. The table according to claim 27, wherein the securing clip includes a rail engagement portion having a head and a shoulder formed on the head, wherein the head is received in an opening of the rail and the shoulder engages the rail so that the head is inhibited from being pulled out of the opening of the upper rail.

29. The table according to claim 27, wherein the valence includes a lower channel extending along a lower edge of the valence and an upper peak formed along an upper edge of the valance, and wherein the securing clip includes a valance engagement portion having an upper tab engaging the upper peak of the valence and a lower hook engaging the lower channel of the valence.

30. The table according to claim 27, wherein the securing clip is made of a resilient material.

* * * * *